US005657622A

United States Patent [19]

Karageorgiou

[11] Patent Number: 5,657,622

[45] Date of Patent: Aug. 19, 1997

[54] HIGH SPEED YARN TWISTER WITH FLUID PROPELLED YARN GUIDE

[75] Inventor: Theodore G. Karageorgiou, Arden, N.C.

[73] Assignee: BASF Corporation, Mount Olive, N.J.

[21] Appl. No.: 583,709

[22] Filed: Jan. 5, 1996

[51] Int. Cl.[6] ..... D01H 1/00

[52] U.S. Cl. ..... 57/66; 57/125; 57/334

[58] Field of Search ..... 57/66, 67, 74, 57/75, 125, 334, 341, 344, 124, 73

[56] References Cited

U.S. PATENT DOCUMENTS

| | | | |
|---|---|---|---|
| Re. 27,717 | 8/1973 | Breen et al. | 57/333 |
| 588,817 | 8/1897 | Draper | 57/125 |
| 1,542,500 | 6/1925 | Gordon | 57/125 |
| 3,324,643 | 6/1967 | Kluttz | 57/124 |
| 3,903,689 | 9/1975 | Chilpan | 57/125 |
| 4,034,546 | 7/1977 | Hashizume | 57/346 |
| 4,319,450 | 3/1982 | Igel | 57/75 |
| 4,372,107 | 2/1983 | Hart | 57/346 |

*Primary Examiner*—Daniel P. Stodola
*Assistant Examiner*—Tina R. Taylor
*Attorney, Agent, or Firm*—Nixon & Vanderhye P.C.

[57] ABSTRACT

A yarn twister mechanically twists a filamentary yarn prior to take-up so as to improve filament-to-filament cohesion. The yarn twister most preferably includes an annular housing defining an annular race in which a follower element is orbitally movable. Pressurized fluid (e.g., air) is introduced substantially tangentially into the race so as to propel the follower in an orbital path along the race. The follower includes a yarn guide element which radially extends through an annular slot in the housing into the housing's cylindrical interior region. The pressurized fluid is discharged through the slot into the cylindrical interior region of the housing so as to provide a fluid bearing for the follower. In use, the traveling yarn will thereby be guided through the yarn guide so that orbital movement of the follower will responsively impart a desirable twist to the yarn so as to increase the filament-to-filament cohesion of the yarn.

27 Claims, 4 Drawing Sheets

HIGH SPEED YARN TWISTER WITH FLUID PROPELLED YARN GUIDE

FIELD OF INVENTION

The present invention relates generally to the field of synthetic filament production. In preferred forms, the present invention is embodied in a device which serves to twist multiple filaments of yarn during production so as to improve yarn filament-to-filament cohesion.

BACKGROUND AND SUMMARY OF THE INVENTION

Yarns composed of multiple filaments are traditionally produced by melt-spinning techniques whereby a melt-spinnable polymer is extruded through relatively small-sized orifices in a spin pack to form a stream of filaments which are substantially immediately solidified in a quench cabinet and converged after solidification to form a yarn composed of multiple filaments. The yarn is thereafter continuously taken up by a high speed winder to form a generally cylindrical yarn package. Depending on the intended end use, the yarn may be flat (undrawn) or may be subjected to a drawing step prior to being taken up to form the package.

In an effort to improve the filament-to-filament cohesion of the yarn so as to ensure that the individual filaments remain integral with the yarn during subsequent processing (e.g., warping), it has been conventional practice to subject the yarn prior to take-up to interlacing. In general, during interlacing, a high velocity fluid (e.g., air, steam or the like) is brought to bear on the converged filaments of the yarn so as to achieve a random mixing or interlacing of the individual filaments comprising the yarn. However, for some high speed spinning operations, fluid jet interlacing is not entirely satisfactory.

According to the present invention, a yarn twister is provided which mechanically twists the yarn prior to take-up so as to improve filament-to-filament cohesion. In this regard, the yarn twister most preferably includes an annular housing defining an annular race in which a follower element is orbitally movable. Pressurized fluid (e.g., air) is introduced substantially tangentially into the race so as to propel the follower in an orbital path along the race. The follower includes a yarn guide element which radially extends through an annular slot in the housing into the housing's interior space. The pressurized fluid is discharged through the slot so as to provide for a fluid bearing for the follower and thereby minimize frictional resistance thereof during its orbital movement. The traveling yarn will thereby be guided through the yarn guide in use so that orbital movement of the follower will responsively impart a desirable twist to the yarn so as to increase the filament-to-filament cohesion of the yarn.

These and further aspects and advantages of the present invention will become more clear after careful consideration is given to the following detailed description of the preferred exemplary embodiment thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
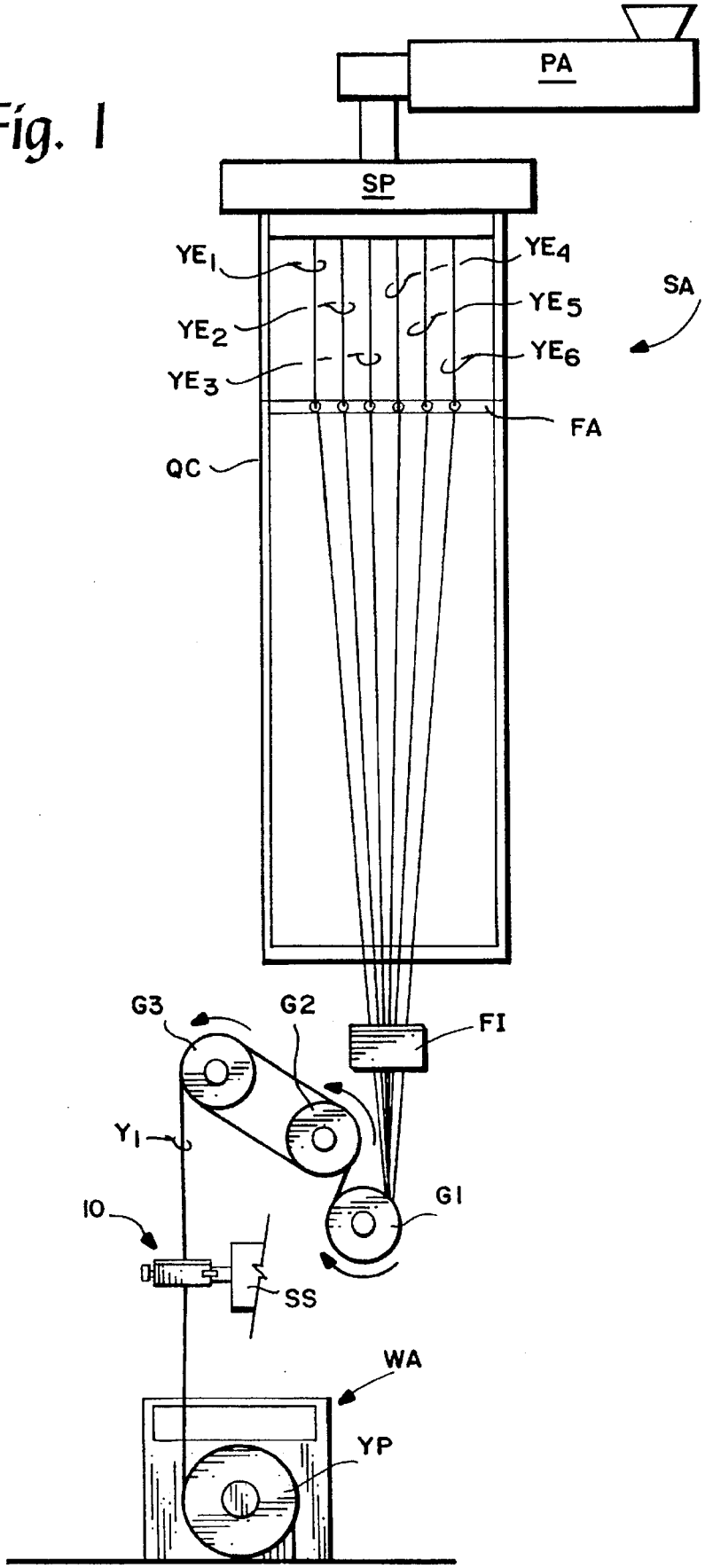
FIG. 1 is a schematic elevational view showing a particularly preferred yarn spinning apparatus in which the high speed yarn twister of the present invention may be employed.

A schematic view of an exemplary yarn spinning apparatus SA in which the yarn twister 10 according to this invention may be used is shown schematically in accompanying FIG. 1. As shown, the yarn spinning apparatus SA generally includes a polymer extruder PA which melts and kneads a melt-spinnable polymer (e.g., nylon) and feeds a flow of the polymer melt to a spin pack SP. The spin pack is conventional in that it includes a plurality of grouped orifices through which the polymer melt is forced so as to form a corresponding plurality of yarn ends $YE_1$–$YE_6$. In this regard, each of the yarn ends $YE_1$–$YE_6$ itself includes a plurality of individual filaments corresponding in number to the number of orifices in an orifice grouping within the spin pack SP. Furthermore, six yarn ends $YE_1$–$YE_6$ each composed of multiple (e.g., preferably six to twelve or more) individual filaments just happens to be depicted in FIG. 1. Thus, more or less than the depicted six yarn ends $YE_1$–$YE_6$ may be present for any given melt spinning apparatus SA.

The individual filaments forming the yarn ends $YE_1$–$YE_6$ quickly solidify within the quench cabinet QC downstream of the spin pack SP and may then be contacted with a spin finish oil via finish applicator FA. The filaments in the yarn ends $YE_1$–$YE_6$ may then be converged and passed through a conventional filament interlacer FI. Thereafter, the yarn ends $YE_1$–$YE_6$ are turned 90° and are passed around a take-up godet roll G1 and then sequentially around godet rolls G2 and G3 which are rotated at different speeds so as to draw the filaments in the yarn ends $YE_1$–$YE_6$ therebetween. Each of the yarn ends $YE_1$–$YE_6$ is then directed to a high speed winding apparatus WA where they are wound on separate cores to form separate yarn packages YP. In this regard, it will be understood that only one yarn package YP corresponding to yarn end $YE_1$ is shown in accompanying FIG. 1 since the other yarn ends $YE_1$–$YE_6$ and their corresponding yarn packages are hidden behind yarn end $YE_1$.

Prior to being wound into yarn packages YP, each of the yarn ends $YE_1$–$YE_6$ is passed through a yarn twister 10 according to the present invention. However, it should be noted that the yarn twister 10 may be positioned at any location upstream of the winding apparatus WA, for example prior to godet roll G1. Thus, the location of the twister 10 downstream of godet roll G3 as shown in FIG. 1 represents a presently preferred location and should not be considered limiting.

Figure 2:
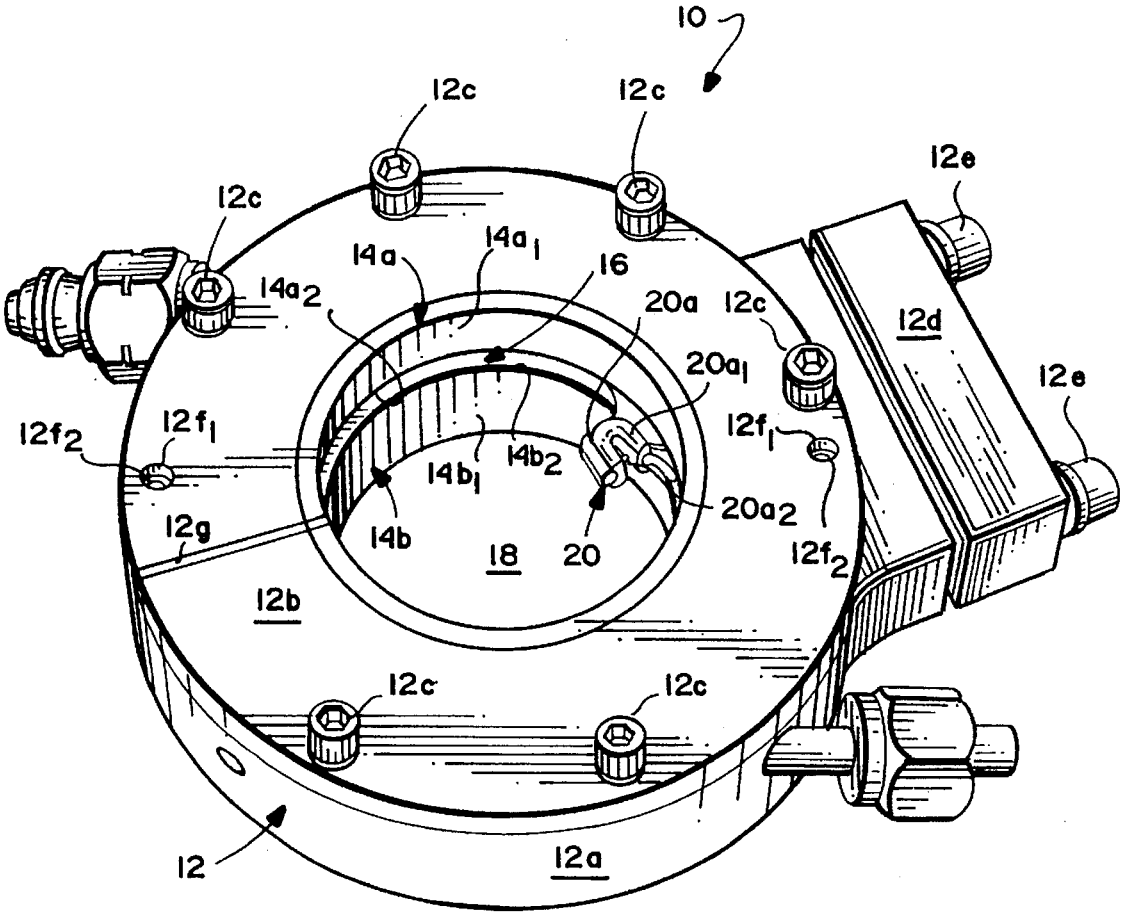
FIG. 2 is a perspective view of the yarn twister according to the present invention.
Figure 3:
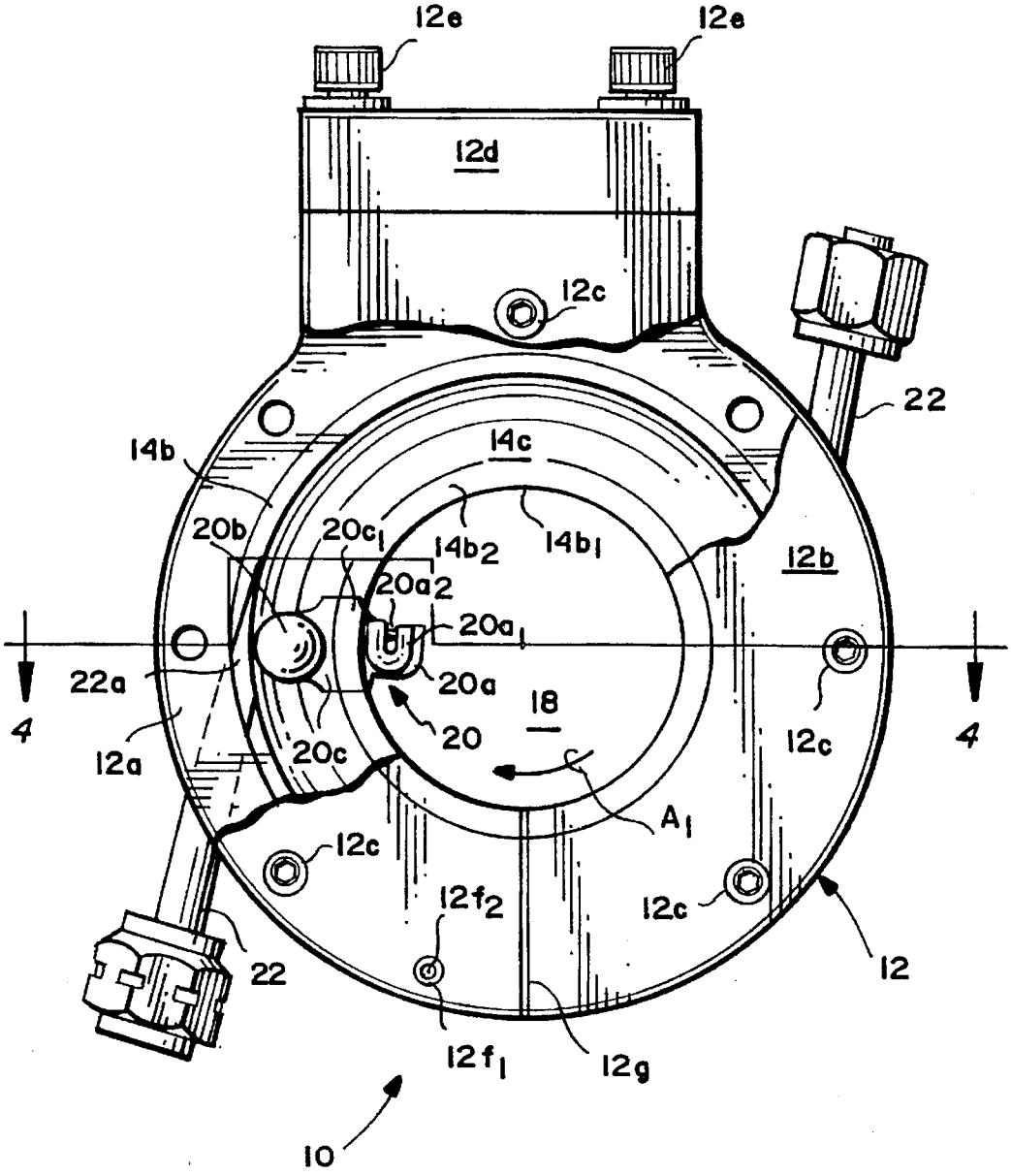
FIG. 3 is a top plan view, partly in section, of the yarn twister of this invention.
Figure 4:
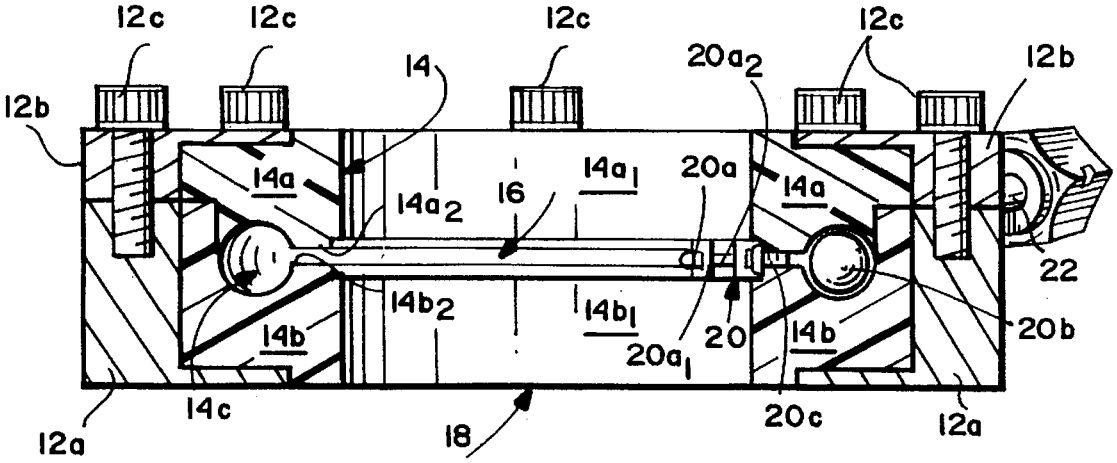
FIG. 4 is a cross-sectional elevational view of the yarn twister of this invention as taken along line 4—4 in FIG. 3.

The twister 10 is shown in greater detail in accompanying FIGS. 2–4. In this regard, the twister 10 includes an annular housing 12 having mated annular base and cap components **12*a*, 12*b*, respectively, which are rigidly coupled together by means of a series of bolts 12*c*. The housing 12 includes a mounting clamp assembly 12*d* which may be clamped by means of bolts 12*e* to support structure SS (see FIG. 1) associated with the spinning apparatus SA so as to position the twister 10 relative to a respective one of the yarn ends $YE_1$–$YE_6$. The proper orientation of the housing base and cap components 12*a*, 12*b*** during assembly is ensured by off-set mated apertures and posts $12f_1$, $12f_2$.

A collar member 14 comprised of mated upper and lower collar components **14*a*, 14*b* each formed of a low friction material (e.g., PTFE) are respectively seated in the base and cap components 12***a*, 12*b* of the housing 12 and collectively establish an annular race 14*c* of generally circular cross-sectional geometry. The interior surfaces 14*a*$_1$, 14*b*$_1$ of the collar components 14*a*, 14*b*, respectively, define a cylindrical interior region 18 of the housing 12 for receiving a respective one of the yarn ends $YE_1$–$YE_6$. A planar inner slot 16 is also established between the opposed planar guide surfaces 14*a*$_2$, 14*b*$_2$ of the collar components 14*a*, 14*b*, respectively, so as to allow the yarn guide 20*a* of the follower 20 to project radially into the interior region 18.

The follower 20 includes a base component 20*b* in the form of a spherical ball which is received within the race 14*c*. The base component 20*b* is most preferably formed of a highly polished stainless steel ball so as to minimize frictional resistance as it travels orbitally (arrow $A_1$ in FIG. 3) along the race 14*c*. The base component 20*b* is rigidly joined to the yarn guide component 20*a* by a planar support flange 20*c* having arcuate bearing surfaces 20*c*$_1$ (only a representative one of which is visible in FIG. 3) positioned between the opposed planar guide surfaces 14*a*$_2$, 14*b*$_2$ of the collar components 14*a*, 14*b*, respectively.

The yarn guide component 20*a* most preferably includes a generally U-shaped ceramic insert 20*a*$_1$ which integrally includes a nib element 20*a*$_2$ positioned at the insert's open end so as to assist in retaining a yarn end therein during use. In order to allow a respective one of the yarn ends to be introduced into the interior space 18 of the housing 12, a vertically oriented, radially extending entrance slot 12*g* is defined in the housing 12 opposite of the mounting clamp assembly 12*d*.

In the embodiment shown in the accompanying FIGURES, the twister 10 includes a pair of fluid inlet conduits 22 each of which is fluid-connected to an inlet port 22*a* (only a repsresentative one of which is shown in FIG. 3) which opens into the race 14*c*. The inlet ports 22*a* of each conduit 22 are positioned so as to be substantially tangential to the race 14*c* so that pressurized fluid introduced thereinto will impinge upon the base component 20*b* and thereby propel it along the race 14*c*. Such orbital movement of the base component 20*b* will likewise cause the yarn guide component 20*a* in which a respective one of the yarns $YE_1$–$YE_6$ is held to orbit in the direction of arrow $A_1$ so as to impart a desirable twist to the yarn.

The base component 20*b* is received within the race 14*c* with a slight clearance space. Likewise, the arcuate bearing surface 20*c*$_1$ is positioned with slight clearance spaces between the opposed planar guide surfaces 14*a*$_2$, 14*b*$_2$ of the collar components 14*a*, 14*b*, respectively. As a result, the pressurized fluid which is introduced into the race 14*c* and propels the base component 20*b* therealong will escape through the slot 16 defined between the guide surfaces 14*a*$_2$, 1462. The pressurized fluid which escapes through the slot 16 thereby serves as a fluid bearing for supporting the bearing surface 20*c*$_1$ in noncontacting relationship with each of the guide surfaces 14*a*$_2$, 14*b*$_2$ during orbital movement of the yarn guide 20 so as to prevent substantial wear from occurring over time. Furthermore, the fluid bearing which is achieved as described above means that lubricants (which could possibly contaminate the yarn ends being twisted) are not necessarily needed during operation of the twister 10 according to this invention.

Although a single fluid inlet conduit and its associated port 22*a* could possibly be employed, it is preferred that multiple fluid inlet conduits/ports be employed which are circumferentially spaced-apart substantially equidistantly along the race 14*c*. The equidistant spacing of the inlet ports helps to ensure that the follower 20 is propelled along the race 14*c* at a substantially constant rate of revolution. In this regard, it has been found that the pressure of the fluid introduced into the race should be at a pressure of at least about 90 psig in order to propel the follower 20 at a rate of about 3200 RPM and impart 1 to 2 twists per meter to the yarn end. RPM's of greater than 3200, for example, about 6000 RPM may be achieved so as to impart to the yarn end a corresponding greater number of twists per meter. Increasing the pressure of the fluid introduced into the race 14*c* will therefore increase the RPM of the follower 20. Thus, the pressure of the fluid introduced into the race 14*c* is selected so as to achieve the desired RPM of the follower 20 which, in turn, imparts the desired twists per meter to the yarn end.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A device for twisting a filamentary yarn end comprising:

a housing having a cylindrical interior region, an annular race which surrounds said cylindrical interior region, and an annular guide slot which is open to, and positioned between, said race and said interior region;

a follower having a follower base component positioned in the annular race for movement therealong in a selected orbital direction, and a yarn guide component which radially extends from said follower base component through said slot and into said cylindrical interior region for receiving the filamentary yarn end; and at least one fluid inlet port in fluid communication with said race for introducing a pressurized fluid into said race for impingement upon said base component so as to propel said base component in said orbital direction along said race and thereby responsively cause said yarn guide component to orbitally move along said slot to impart a twist to the filamentary yarn end received thereby.

2. The device of claim 1, wherein said at least one fluid inlet port is positioned so as to introduce the pressurized fluid substantially tangentially into said race.

3. The device of claim 1, comprising a pair of fluid inlet parts which are circumferentially spaced-apart substantially equidistantly along said race.

4. The device of claim 3, wherein each said fluid inlet port is positioned so as to introduce the pressurized fluid substantially tangentially into said race.

5. The device of claim 1, wherein said housing includes an annular housing base and an annular cap rigidly mated to said housing base, and a collar member formed of a low friction material which defines said race, wherein said collar member is seated between said annular housing base and said cap.

6. The device of claim 5, wherein said collar member includes upper and lower collar components respectively seated in the housing base and cap, wherein said upper and lower collar components collectively define said race.

7. The device of claim 5, wherein said collar component has an interior surface which defines said cylindrical interior region of said housing.

8. The device of claim 1, wherein said yarn guide component includes a generally U-shaped insert for receiving the yarn end therein.

9. The device of claim 8, wherein said generally U-shaped insert includes a nib element for retaining the yarn end therein.

10. The device of claim 8, wherein said yarn guide is formed of a ceramic material.

11. The device of claim 1, wherein said follower includes a planar support flange which rigidly joins said base component and said yarn guide component.

12. The device of claim 11, wherein planar support flange includes arcuate bearing surfaces aligned with said slot.

13. The device of claim 12, wherein said slot is defined by a pair of opposed planar guide surfaces.

14. The device of claim 13, wherein said housing includes a collar member formed of a low friction plastics material which defines said race and said slot.

15. The device of claim 1, wherein said housing includes an entrance slot which is longitudinally oriented relative to and radially extends from said cylindrical interior region.

16. The device of claim 1, wherein said race has a circular cross-section and said base component of said follower is a spherical element which is received within the race.

17. A device for twisting filamentary yarn comprising:

a housing defining a cylindrical interior region and an annular race surrounding said interior region;

said housing having a pair of opposed parallel planar surfaces extending from said race to said interior region said surfaces defining therebetween a guide slot; and a follower having a base component received in said annular race for movement therealong in a selected orbital direction, a yarn guide component positioned in said interior region for receiving therein said filamentary yarn, and a planar support flange which radially extends from said follower base component through said slot and is joined to said guide component; wherein said race includes a pair of fluid inlet ports circumferentially spaced-apart substantially equidistantly relative to one another for introducing a pressurized fluid in a substantially tangential direction into the race to propel said base component in said orbital direction, said introduced pressurized fluid being discharged from said housing through said slot so as to provide a fluid bearing for said support flange of said follower.

18. The device of claim 17, wherein said housing includes an annular housing base and an annular cap rigidly mated to said housing base, and a collar member formed of a low friction material which defines said race, wherein said collar member is seated between said annular housing base and said cap.

19. The device of claim 18, wherein said collar member includes upper and lower collar components respectively seated in the housing base and cap, wherein said upper and lower collar components collectively define said race.

20. The device of claim 18, wherein said collar component has an interior surface which defines said cylindrical interior region of said housing.

21. The device of claim 18, wherein said yarn guide component includes a generally U-shaped insert for receiving the yarn therein.

22. The device of claim 21, wherein said generally U-shaped insert includes a nib element for retaining the yarn therein.

23. The device of claim 21, wherein said yarn guide is formed of a ceramic material.

24. The device of claim 18, wherein said planar support flange includes arcuate bearing surfaces aligned with said slot.

25. The device of claim 24, wherein said housing includes a collar member formed of a low friction plastics material which establishes said race and said slot.

26. The device of claim 18, wherein said housing includes an entrance slot which is longitudinally oriented relative to and radially extends from said cylindrical interior region.

27. The device of claim 18, wherein said race has a circular cross-section and said base component of said follower is a spherical element which is received within the race.

* * * * *